US005442822A

United States Patent [19]

Diaz

[11] Patent Number: 5,442,822

[45] Date of Patent: Aug. 22, 1995

[54] FITTED BEDDING HAVING A MATTRESS POCKET AND METHOD OF FABRICATION

[75] Inventor: Clementina R. Diaz, El Sobrante, Calif.

[73] Assignee: Karen Alexander Biase, Oakland, Calif. ; a part interest

[21] Appl. No.: 272,855

[22] Filed: Jul. 8, 1994

Related U.S. Application Data

[63] Continuation of Ser. No. 21,778, Feb. 24, 1993, abandoned.

[51] Int. Cl.[6] ..... A47C 9/02

[52] U.S. Cl. ..... 5/497; 5/499

[58] Field of Search ..... 5/494–499

[56] References Cited

U.S. PATENT DOCUMENTS

| | | | |
|---|---|---|---|
| 1,865,329 | 6/1932 | McHorter | 5/497 |
| 2,151,375 | 3/1939 | DeVoe | 5/497 |
| 2,462,156 | 2/1949 | Berman | 5/496 |
| 2,603,798 | 7/1952 | Crescenzi | 5/497 |
| 2,679,056 | 5/1954 | Simpson | 5/497 |
| 3,868,735 | 3/1975 | Ross | 5/497 |
| 4,245,365 | 1/1981 | Large | 5/497 |
| 4,308,626 | 1/1982 | Weiss | 5/497 X |
| 4,316,279 | 2/1982 | Friedman | 5/497 X |
| 4,698,865 | 10/1987 | Walker | 5/497 |
| 5,027,460 | 7/1991 | Honig | 5/497 |

*Primary Examiner*—Michael F. Trettel
*Attorney, Agent, or Firm*—Philip A. Dalton

[57] ABSTRACT

A fitted sheet is formed from a sheet of fabric including a generally rectangular main panel. Extending from the main panel at its lower end are two side-extensions and a central-extension between the side-extensions. Each extension is generally rectangular and has two longitudinal edges and one lateral edge. The extensions are spaced apart providing an exposed edge-portion of the lower end of the main panel on either side of the central-extension. A pocket is formed in the fitted sheet by attaching to each longitudinal edge of the central-extension an adjacent edge-portion of the main panel and an adjacent longitudinal edge of a side-extension. The sheet is finished by folding each side-extension along a line corresponding to the lower end of the main panel, aligning the lateral edges of the side-extensions with the lateral edge of the central-extension, and stitching the side-extensions to the main panel.

9 Claims, 4 Drawing Sheets

Fig. 4A
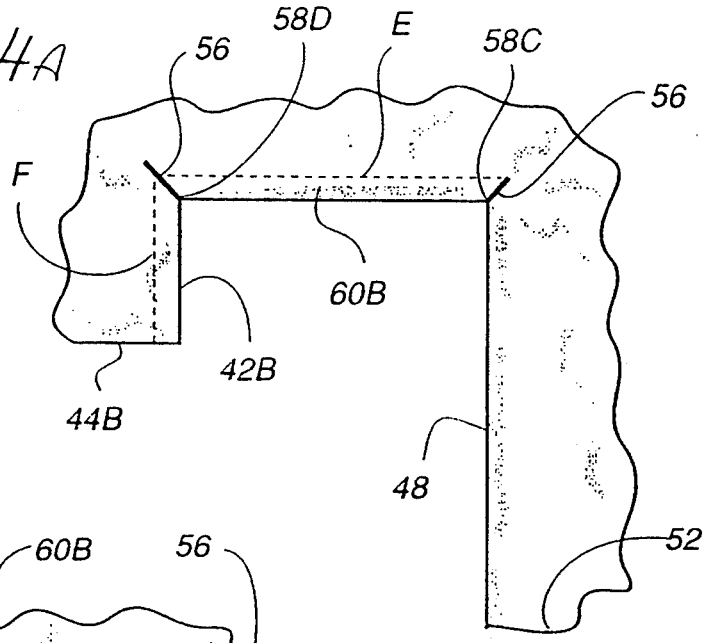
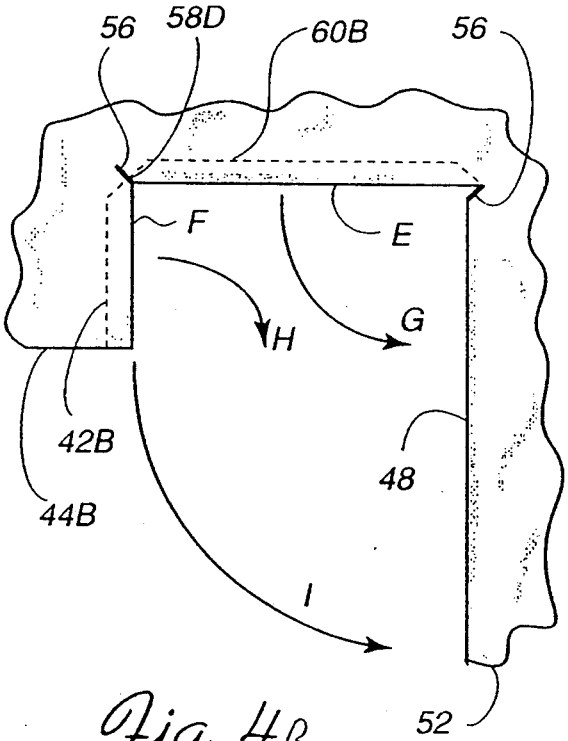
Fig. 4B
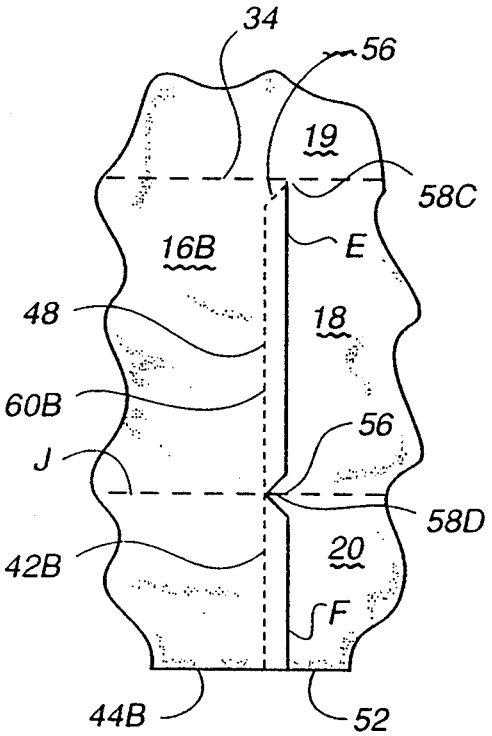
Fig. 4C

FITTED BEDDING HAVING A MATTRESS POCKET AND METHOD OF FABRICATION

This is a continuation of application Ser. No. 08/021,778, filed Feb. 24, 1993, now abandoned.

TECHNICAL FIELD OF THE INVENTION

The present invention relates in general to bedclothes or bedding. It relates in particular to a fitted sheet or topsheet having a pocket therein for receiving one end of a mattress.

DISCUSSION OF BACKGROUND ART

Several forms of bed sheet including a pocket or like means for fitting the sheet on a mattress have been described in the prior art. The manner in which the sheets are formed and assembled varies widely. The form and assembly method for a particular sheet may significantly affect its ease of use, for example, in making-up a bed, the neatness and general appearance of the made-up bed, the comfort of a user, and, of course, the cost of manufacture.

McHorter, U.S. Pat. No. 1,865,329, discloses a unitary combination of upper and lower mattress covers, the combination having a relatively deep pocket at the base for receiving a mattress. It appears from the description that such a combined cover would be expensive to produce, difficult to launder, and would require lifting a mattress and holding the mattress in a lifted position in order to fit the pocket over the mattress.

De Voe, U.S. Pat. No. 2,151,357, discloses a single sheet having a much simpler construction than the unitary sheet of McHorter. The sheet of De Voe includes a rectangular main panel having a width greater than the width of a mattress, thus providing overhanging side panels for covering the edges of the mattress. The main panel has a central flap having a width about equal to the mattress. This flap is folded over and stitched to the overhanging side panels for forming a pocket to receive the mattress. The pocket formation scheme appears to have the disadvantage that repeated removal and fitting of the sheet on a mattress could cause the side panel stitching to gradually loosen, thereby degrading the usefulness of the sheet.

Crescenzi, U.S. Pat. No. 2,603,798 discloses a sheet similar in construction to the sheet of De Voe. In particular, the method of stitching a central flap to side panels for forming a pocket is similar, and the sheet appears to exhibit the same potential for loosening the pocket stitches.

A sheet having an apparently stronger pocket is disclosed by Simpson in U.S. Pat. No. 2,679,056. The sheet of Simpson has a very complex, and thus potentially expensive, construction scheme. The construction scheme includes edge beading and corner gussets for strengthening the pocket, and a reserve of folded material to avoid unduly constraining the feet of an occupant of a mattress covered by the sheet.

Large, U.S. Pat. No. 4,245,365, discloses a sheet which includes a shallow pocket having sides formed by diagonal gussets. The sheet includes side panels. The pocket is not secured permanently to the side panels, but may be secured temporarily thereto by a hook and eye arrangement. From the description, it appears necessary to lift the mattress in order to operate the hook and eye arrangement.

SUMMARY OF THE INVENTION

It is an object of the present invention to provide a fitted sheet or other bedding, including a pocket, which may be quickly attached to a mattress or other support, preferably without a requirement to raise the mattress or support for attaching the sheet.

It is a further object of the invention to provide a fitted sheet having a simple design, which is economical to produce, and which may be folded flat for pressing or storage without bunching or clumping of the fabric of the sheet, particularly at pocket corners.

It is yet another object of the invention that the mattress pocket be of strong and durable construction for withstanding repeated fitting and removal on a mattress.

The present invention is described with reference to a fitted sheet, such as a top sheet, and a mattress. Embodied in a topsheet, the present invention provides for ease of fit over a mattress and underlying sheet, and resistance to unwanted shifting or "coming off" during use. However, the present invention is not limited to sheets; it is applicable to other bedding such as blankets, comforters, etc., and more generally to covers having a pocket for attachment to a support.

In one aspect of the present invention, the above and other objects of the present invention are achieved by providing a fitted bedsheet for a mattress, comprising a sheet of fabric, including a generally rectangular main panel, the main panel having an upper end, a lower end, and first and second longitudinal sides. The sheet of fabric includes first and second generally rectangular side-extensions extending from the lower end of the main panel. Each of the side-extensions has outer and inner opposite longitudinal edges and a free lateral edge. Each of the outer edges of the side panels is aligned with a corresponding one of the first and second longitudinal sides of the main panel.

The sheet of fabric further includes a generally rectangular central-extension extending from the lower end of the main panel between the side-extensions and spaced apart therefrom. The central-extension has first and second opposite longitudinal edges, each thereof having a length greater than the depth of the mattress, and a free lateral edge having a length corresponding to the width of the mattress.

The central and the first and second side-extensions are spaced such that respectively first and second edge-portions of the lower end of the main panel are exposed and located therebetween. Each of the edge-portions has a length corresponding to the depth of the mattress.

The first edge-portion of the main panel and the innermost edge-portion of the first side-extension are aligned with and attached to the first longitudinal edge of the central-extension. The second edge-portion of the main panel and the innermost edge of the second side-extension are aligned with, and attached to, the second longitudinal edge of the central-extension. According to this attachment scheme, a pocket is formed in the sheet, for receiving the mattress.

In another aspect of the present invention, each of the side-extensions is folded under the main panel, and the free lateral edges of the side-extensions are aligned with the free lateral edge of the central-extension and attached to the main panel, for finishing the sheet.

Preferably, the innermost edges of the side-extensions are equal in length and the longitudinal edges of the central-extension each have a length about equal to the depth of the mattress plus the length of one of the innermost edges.

The fitted sheet of the present invention may be folded :and creased along a line extending diagonally toward the first side of the main panel from a junction point between the first longitudinal edge of the central-extension and the first edge-portion of the main panel, and along a second line extending diagonally toward the second side of the main panel from a junction point between the second longitudinal edge of the central-extension and the second edge-portion of the main panel.

The pocket is a relatively shallow pocket and the assembly or construction scheme provides a strong and durable construction for the pocket. This construction scheme of the pocket also provides that the sheet may usually be pulled into position on a mattress without a requirement to lift the mattress.

The fitted sheet of the present invention is particularly convenient to launder and to store. The construction scheme provides that the sheet, and the pocket may be folded and pressed flat without the "corner bunching" frequently encountered in prior art fitted sheets.

BRIEF DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

FIGS. 4A–C are fragmented views illustrating assembly details for the pocket of FIG. 2.

DETAILED DESCRIPTION OF PREFERRED EMBODIMENTS

Figure 1:
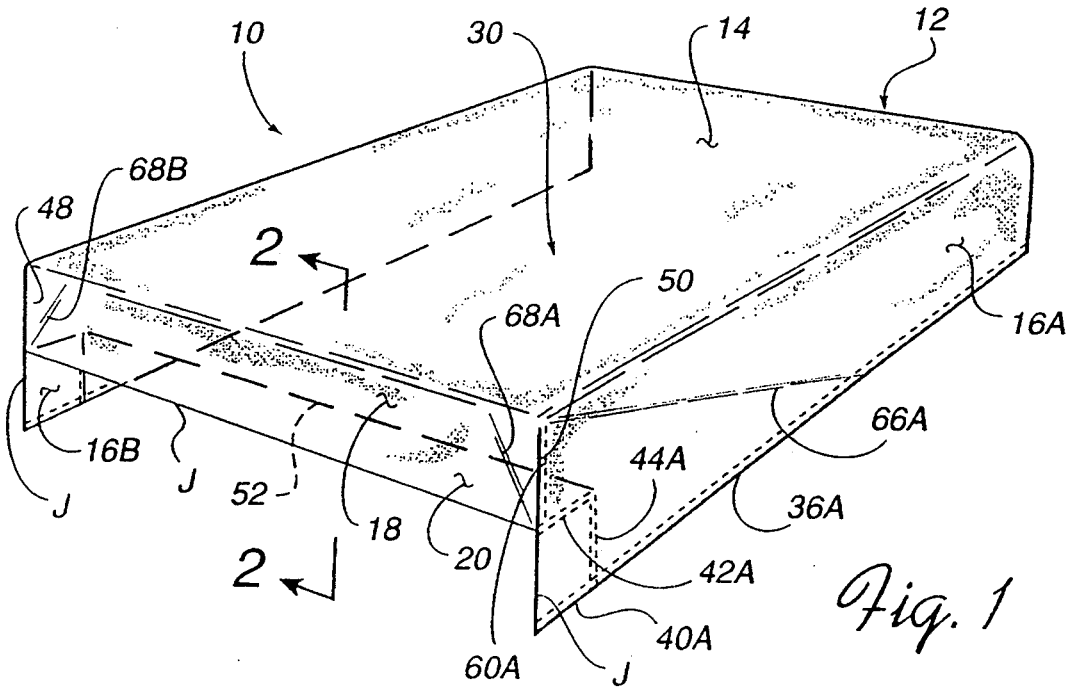
FIG. 1 is a perspective view schematically illustrating one embodiment of a fitted sheet in accordance with the present invention.
Figure 2:
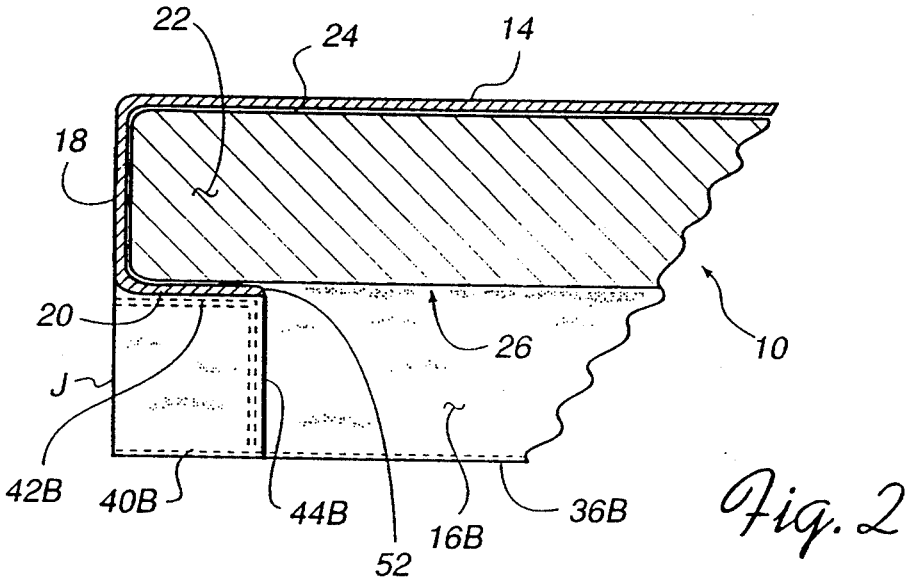
FIG. 2 is a cross section view seen generally in the direction 2—2 of FIG. 1 schematically illustrating details of a pocket in the fitted sheet of FIG. 1.

Referring now to the drawings, FIG. 1 illustrates one preferred form of a fitted top sheet 10 in accordance with the present invention. The form illustrated is that which the sheet would take when fitted properly to a mattress of corresponding dimensions. For clarity of illustration, the mattress has been omitted from FIG. 1. FIG. 2 shows detail illustrating fitting a mattress into a pocket formed in the sheet.

Preferably, the fitted sheet is fabricated from a single sheet 12 of a suitable fabric such as cotton or linen. Assembled as illustrated in FIG. 1, sheet 12 forms a main or cover panel 14, side panels 16A and 16B, an end-panel 18, and a pocket base panel 20. Together, cover panel 14, side panels 16A and 16B, end-panel 18, and pocket base panel 20 enclose a pocket 22 (See FIG. 2) for receiving an end 24 of a mattress 26.

The pocket 22 is preferably arranged with the pocket panel 20 extending longitudinally, preferably no more than the depth (or height), d, of mattress 26. It is thought that a maximum 5 inch panel dimension would be suitable for all standard mattress thicknesses. This provides that the pocket may be easily fitted to the mattress by, at most, only slightly raising the end of the mattress. It has been determined that, with practice, the pocket may be simply pulled onto the mattress without raising the mattress at all.

For workers, such as hospital workers or hotel workers, who may be required to make-up several beds in a work period, this ease of fitting is very effective in reducing fatigue and minimizing the risk of back injury which is associated with heavy lifting.

The easy fitting feature of the sheet of the present invention is due to a preferred method, set forth below, according to which the fabric sheet 12 is formed and stitched together to form the pocket.

Figure 3:
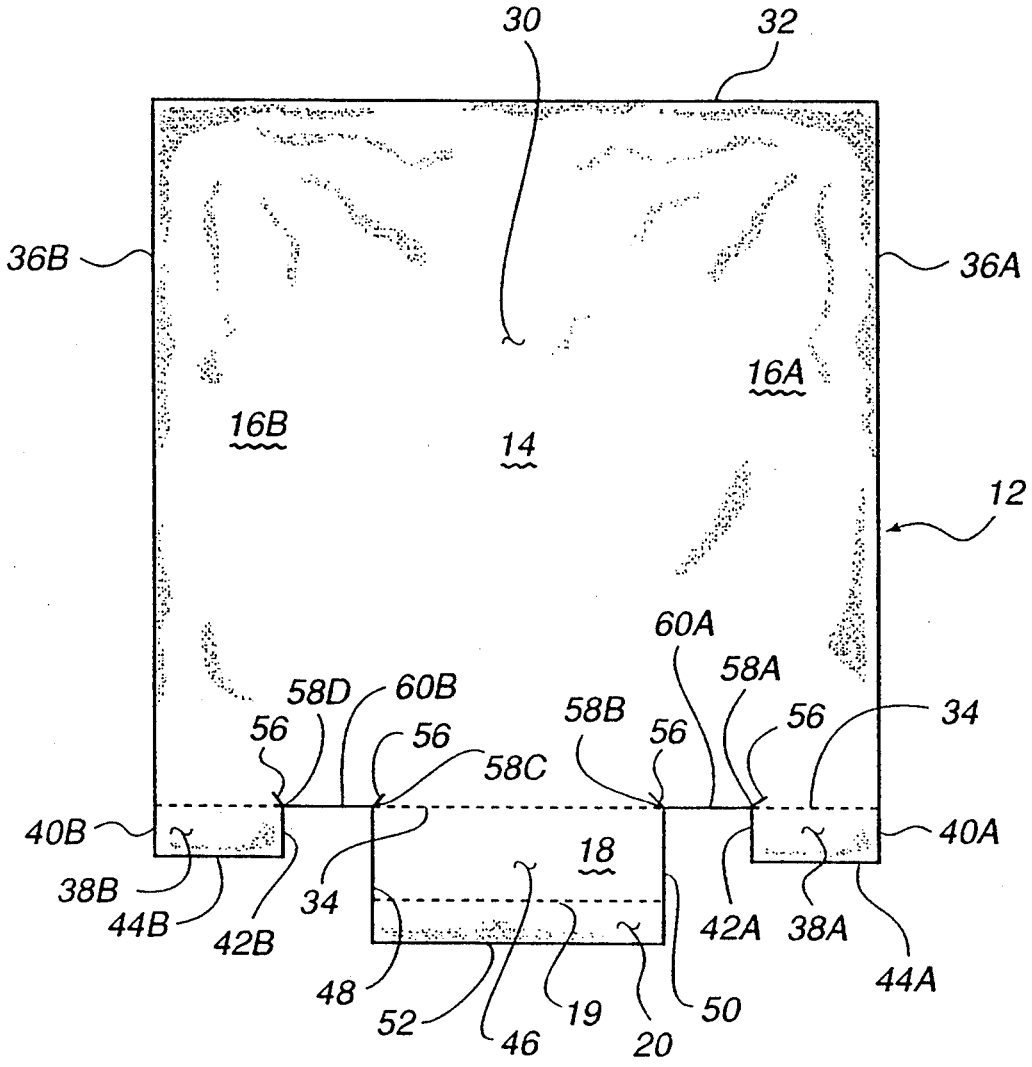
FIG. 3 is a plan view schematically illustrating a fabric sheet for forming the fitted sheet of FIG. 1.

Referring now to FIG. 3, sheet 12 is formed (eg. by cutting from a strip of fabric or fabric yardage) such that it includes a generally rectangular main panel 30. The panel 30 has an upper end 32 and a lower end 34 (illustrated partly in broken line and partly in solid line) and right and left longitudinal sides 36A and 36B respectively. Throughout this description and in claims appended hereto the term "longitudinal" is used to indicate a direction generally perpendicular to ends 32 and 34, i.e., the length direction of the sheet. The term "lateral" will be used to indicate a direction generally parallel to ends 32 and 34, i.e. the width direction of the sheet. The term "upper side" of sheet 12 and components thereof indicates the side which is uppermost or outermost when the sheet positioned normally on a mattress. The term "underside" applies, of course, to the side of the sheet opposite the upper side.

Continuing with reference to FIG. 3, extending from lower end 34 of the main panel 30 are two side-extensions 38A and 38B. Each of extensions 38A and 38B has outer longitudinal edges 40A and 40B, respectively, inner longitudinal edges 42A and 42B, respectively, and free outer lateral edges 44A and 44B respectively. The outer longitudinal edges 40A and 40B are preferably generally aligned with edges sides 36A and 36B, respectively, of main panel 30.

Between side-extensions 38A and 38B, and spaced apart therefrom, is a central-extension 46 which extends from the central section of the lower end 34 of sheet 12. The three extensions 38A, 46, 38B are spaced such that free edge-portions 60A and 60B of end 34 of main panel 30, located between the extensions, are exposed. Each of these lower-end edge-portions or seam allowances has a length about equal to the depth of mattress 26.

The central-extension 46 has two opposite longitudinal edges 48 and 50, and a free lateral edge 52. Each of longitudinal edges 48 and 50 has a length greater than the depth of mattress 26. This is required to provide sufficient material to form end-panel 18 and lower pocket panel 20 (shown separated by broken line 19 in FIG. 3) when sheet 12 is stitched together to form pocket 22. As mentioned previously, preferably the depth of the free lateral edge 52 is equal to the width of the mattress, but it is expected that a maximum depth will provide sufficient pocket support for substantially all standard size mattresses.

Preferably inner longitudinal edges 42A and 42B of side-extensions 38A and 38B each have the same length, and longitudinal edges 48 and 50 of central-extension 46 each have a length about equal to the depth of mattress 26 plus the length of a side-extension inner edge, for example edge 42A. Further, it is preferable that diagonal incisions or darts 56 be provided in sheet 12 at junction points 58A (between inner edge 42A and edge-portion 60A)and 58B (between longitudinal edge 50 and edge-portion 60A). The purpose of these darts is explained further below.

Sheet 12 may be conveniently cut as a single piece of fabric from a larger piece of the fabric. This may be done by placing a template or pattern on the larger piece of fabric and tracing around the template with a suitable marker, such as a pencil. The sheet 12 may be cut from the larger piece of fabric using scissors, shears, or the like. A series of templates may be made, each thereof corresponding to dimensions of a particular industry standard mattress size. For example, fabric would be spread on a cutting table, layered or stacked to include the yardage for the amount of sheets in a particular size cutting, then cut to size. Also, the process may be automated by cutting sheets 12 of different sizes from a continuous strip of material. Typically, in an automated process, the material would be indexed into position for cutting, cut, indexed to position a new section for cutting again, then cut, etc. etc.

Before stitching sheet 12 together to form finished fitted sheet 10, it may be preferable to clean finish certain ones of the free edges of the sheet, for example, those edges which will remain free after the sheet is assembled, for neatness and to prevent fraying. Preferably, end 32, sides 36A and 36B, and pocket end 52 are clean finished by a french seam. Also, edges 44A and 44B, which will be stitched to the side panels 16A and 16B, are clean finished without using a french seam.

Referring now to FIGS. 4A, FIG. 4B and FIG. 4C for details, as well as to FIG. 3, pocket 20 is formed by attaching, along and to one side of central-extension 46, edge-portion 60A of end 34, and inner edge 42A of side-extension 38A, to longitudinal edge 50 of central-extension 46. A preferred procedure for attaching the edges is as follows.

Continuing with reference to FIG. 4A, edge-portion 60B and inner edge 42B are each folded back on themselves along lines E and F respectively. This is facilitated by darts 56. Next, as illustrated in FIG. 4B, the folded-back inner edge or seam allowance 42B and folded-back edge-portion or seam allowance 60B are aligned by pulling them apart, as shown by arrows G and H. As illustrated by arrows G and I, the two seam allowances are rotated towards edge 48 until they are aligned, substantially end to end, with and along longitudinal edge 48 on the upper side thereof, as illustrated in FIG. 4C. All three edges are then stitched together, preferably with a double row of stitching (not shown).

A similar procedure is followed for attaching on the opposite side of the pocket 20 edge-portion 60A of end 34, and inner edge 42A of side-extension 38B, to longitudinal edge 50 of central-extension 46.

After side-extensions 38A and 38B have been attached to the opposite edges 50 and 48 of central-extension 46 in the above-described manner, the formation of pocket region 22 is essentially completed. To complete the formation of fitted sheet 10, side-extensions 38A and 38B are each folded back, under main panel 30, along a line J (See FIGS. 1, 2, and 4C), generally corresponding to the lower end of end-panel 18.

Lateral edges 44A and 44B of the side-extensions are then aligned with free lateral edge 52 of central-extension 46, while maintaining outer longitudinal edges 40A and 40B of the side-extensions in alignment with longitudinal sides 36A and 36B, respectively, of main panel 30.

When aligned in the above described manner, the outer longitudinal and free lateral edges of the side-extensions are stitched to main panel 30, i.e., to side panel portions 16A and 16B of main panel 30 (See FIGS. 1 and 2).

An advantageous feature of the fitted sheet of the present invention is that it may be easily folded flat, for example, for convenience of storage and convenience in laundering and pressing.

Figure 5:
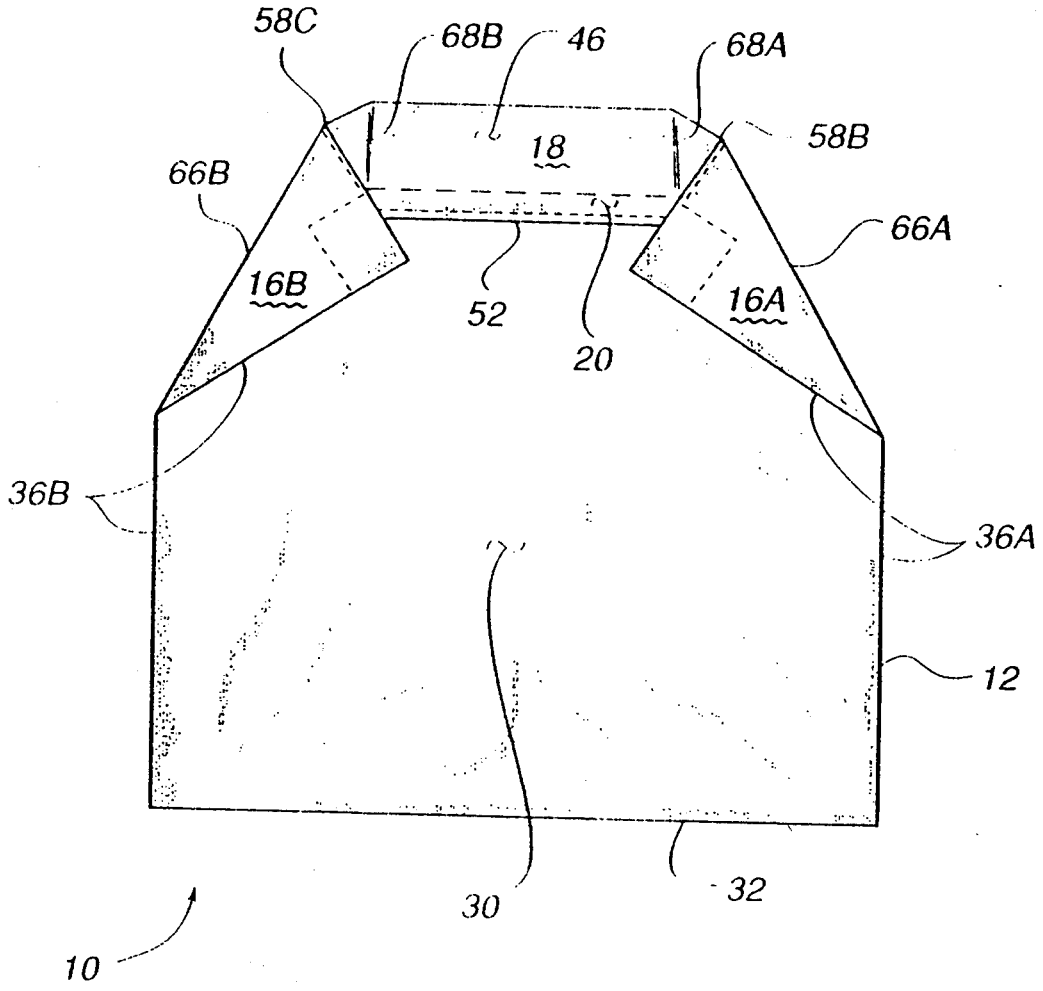
FIG. 5 is a plan view from the underside of the fitted sheet of FIG. 1 schematically illustrating a folding scheme for the fitted sheet.

One exemplary manner of folding the fitted sheet is illustrated in FIG. 5. Here, side panel portions 16A and 16B of main panel 30 are folded towards the underside of sheet 12 along lines 66A and 66B respectively. These fold lines will, of course, form creases in main panel 30 if the sheet is pressed or ironed in the folded condition. Fold lines or creases 66A and 66B extend, respectively, along lines extending diagonally toward sides 36A and 36B of main panel 30, from about junction points 58B and 58C, which lies between longitudinal edges 50 and 48 of central-extension 46 and edge-portions 60A and 60B of the main panel.

Folding may be further facilitated by folding end panel portion 18 of central-extension 46 along fold lines or creases 68A and 68B. Fold line 68A preferably extends diagonally toward cover panel portion 14 of main panel 12, from about junction point 58A, which lies between inner longitudinal edge 42A of side-extension 38A and edge-portion 60A of main panel 30.

Similarly, fold line 68B preferably extends diagonally toward cover panel portion 14 of main panel 12 from about junction point 58D, which lies between inner longitudinal edge 42A of side-extension 38A and edge-portion 60A of main panel 30. It should be noted that when fitted sheet 10 is in position on a mattress, crease 68A and 68B will open essentially flat, thus providing a neat appearance for end-panel 18.

For completeness of description, fold lines or creases 66A, 66B, 68A and 68B are indicated in FIG. 1.

When folded as described above, the fitted sheet of the present invention will lie flat and Will not exhibit any of the "corner bunching" frequently associated with prior art fitted sheets when they are folded.

A further advantage of the above-described folding scheme is that the converging diagonal form of folds 66A and 66B in effect forms a guide which helps rapidly position the pocket region of the sheet on the end of a mattress.

In conclusion, a fitted sheet including a pocket for receiving and end of a mattress has been described. The sheet includes side panels which may be tucked under a mattress when the sheet is installed, or allowed to hang suspended. The pocket is a relatively shallow pocket and is stitched according to a scheme which provides a strong and durable construction for the pocket.

This construction or assembly scheme of the pocket provides that the sheet may usually be pulled into position on a mattress, without a requirement to lift the mattress. This is of considerable advantage for workers in hospitals, hotels, and the like, who may be required to make-up many beds in a single work period. Avoiding having to lift mattresses saves time and reduces worker fatigue as well as significantly reducing chances of back injury or strain.

The fitted sheet of the present invention is particularly convenient to launder and to store. The construction scheme of the pocket provides a tendency to maintain the pocket open when the sheet is not folded, thus facilitating circulation of water during laundering. In addition the scheme provides that the sheet, and the pocket may be folded and pressed flat without corner bunching.

Finally, but not exhaustively, a fitted sheet in accordance with the present invention may be made from less fabric than prior art fitted sheets. This, together with relative ease of assembly, makes it economical to produce.

Various alternatives will be readily applied by those of usual skill in the art. As mentioned previously, the invention as described applies generally to covers attached over supports via a pocket. Also, various sewing and other fabrication techniques can be used. For example, for economy, it may be desirable to use safety stitching or overlock seams in place of french seams.

The present invention has been described in terms of a preferred embodiment and a number of other embodiments. The invention however is not limited to the embodiments described and depicted. Rather, the scope of the invention is defined by the appended claims.

What is claimed is:

1. A fitted sheet for a mattress, comprising:

a sheet of fabric, including a generally rectangular main panel, said main panel having an upper end, a lower end, and first and second longitudinal edges or sides;

said sheet of fabric including first and second generally rectangular side-extensions extending from said lower end of said main panel, each of said side-extensions having an outer and an inner opposite longitudinal edge and a free lateral edge, each of said outer edges being aligned with a corresponding one of said first and second longitudinal side edges of said main panel;

said sheet of fabric further including a generally rectangular central-extension extending from said lower end (34) of said main panel between said side-extensions and spaced apart therefrom, said central-extension having first and second opposite longitudinal edges, each thereof having a length greater than the depth of the mattress, and a free lateral edge having a length corresponding to the width of the mattress;

said central side extension and said first and second side-extensions being spaced such that respectively first and second edge-portions of said main panel are located therebetween, each of said edge-portions having a length corresponding to the depth of the mattress; and said first edge-portion of said main panel and said innermost edge of said first side-extension being aligned with and attached to said first longitudinal edge of said central-extension, and said second edge-portion of said main panel and said innermost edge of said second side extension being aligned with and attached to said second longitudinal edge of said central-extension, thereby forming a pocket for receiving the mattress.

2. The fitted sheet of claim 1 wherein said innermost edges of said side-extensions are equal in length and said longitudinal edges of said central-extension each have a length about equal to the combined length of one of said first and second edge portions of said main panel plus the length of one of said innermost edges.

3. The fitted sheet of claim 2 wherein each of said side- extensions is folded under said main panel, and said free lateral edges of said side-extensions are aligned with said free lateral edge of said central-extension and attached to said main panel.

4. The fitted sheet of claim 3 further including a first crease extending diagonally toward said first side of said main panel from a junction point between said first longitudinal edge of said central-extension and said first edge-portion of said main panel, and a second crease extending diagonally toward said second side of said main panel from a junction point between said second longitudinal edge of said central-extension and said second edge-portion of said main panel.

5. A method for forming a fitted sheet having a pocket at one end thereof for receiving an end of a mattress, the method comprising the steps of:

(a) providing a sheet of fabric for forming the bedsheet, said sheet of fabric including a generally rectangular main panel having an upper end, a lower end, and first and second longitudinal sides; said sheet of fabric including first and second generally rectangular side-extensions extending from said lower end of said main panel, each of said side-extensions having outer and inner opposite longitudinal edges and a free lateral edge, each of said outer edges being aligned with a corresponding one of said first and second longitudinal sides of said main panel; said sheet of fabric further including a generally rectangular central-extension extending from said lower end of said main panel between said side-extensions and spaced apart therefrom, said central-extension having first and second opposite longitudinal edges each thereof having a length greater than the depth of the mattress and a free lateral edge having a length corresponding to the width of the mattress; and said central and said first and second side-extensions spaced such that respectively first and second edge-portions of said main panel are located therebetween, each of said edge-portions having a length corresponding to the depth of the mattress;

(b) aligning said first edge-portion of said main panel and said inner longitudinal edge of said first side-extension with said first longitudinal edge of said central-extension;

(c) attaching said first edge-portion of said main panel and said inner longitudinal edge of said first side-extension to said first longitudinal edge of said central-extension;

(d) aligning said second edge-portion of said main panel and said innermost edge of said second side-extension with said second longitudinal edge of said central-extension; and (e) attaching said second edge-portion of said main panel and said innermost edge of said second side-extension to said second longitudinal edge of said central-extension.

6. The method of claim 5 further including the steps of:

(f) folding each of said side-extensions under said main panel; and (g) aligning said free lateral edges of said side-extensions with said free lateral edge of said central extension; and attaching said free lateral edges of said side-extensions to said main panel.

7. The method of claim 6 further including the steps of:

(h) folding said main panel along a line extending diagonally toward said first side of said main panel from a junction point between said first longitudinal edge of said central-extension and said first edge-portion of said main panel; and (i) folding said main panel along a line extending diagonally toward said second side of said main panel from a junction point between said second longitudinal edge of said central-extension and said second edge-portion of said main panel.

8. The method of claim 7 wherein said innermost edges of said side-extensions are equal in length and said longitudinal edges of said central-extension each have a length about equal to the depth of the mattress plus the length of one of said innermost edges.

9. A fitted sheet for a mattress, comprising:

a sheet of fabric, including a generally rectangular main panel, said main panel having an upper end, a lower end, and first and second longitudinal edges or sides;

said sheet of fabric including first and second generally rectangular side-extensions extending from said lower end of said main panel, each of said side-extensions having an outer and an inner opposite longitudinal edge and a free lateral edge, each of said outer edges being aligned with a corresponding one of said first and second longitudinal side edges of said main panel;

said sheet of fabric further including a generally rectangular central-extension extending from said lower end of said main panel between said side-extensions and spaced apart therefrom, said central-extension having first and second opposite longitudinal edges, each thereof having a length greater than the depth of the mattress, and a free lateral edge having a length corresponding to the width of the mattress;

said central side extension and said first and second side-extensions being spaced such that respectively first and second edge-portions of said main panel are located therebetween, each of said edge-portions having a length corresponding to the depth of the mattress;

said first edge-portion of said main panel and said innermost edge of said first side-extension being aligned with and attached to said first longitudinal edge of said central-extension, and said second edge-portion of said main panel and said innermost edge of said second side extension being aligned with and attached to said second longitudinal edge of said central-extension, thereby forming a pocket for receiving the mattress; and each of said side-extensions being folded under said main panel, and said free lateral edges of said side-extensions being aligned with said free lateral edge of said central-extension and attached to said main panel.

* * * * *